US006572239B1

(12) United States Patent
Harbin

(10) Patent No.: US 6,572,239 B1
(45) Date of Patent: Jun. 3, 2003

(54) STORAGE AND DISPLAY APPARATUS

(76) Inventor: Michael R. Harbin, 111 Mountain View Dr., Huntsville, AL (US) 35811

( * ) Notice: Subject to any disclaimer, the term of this patent is extended or adjusted under 35 U.S.C. 154(b) by 0 days.

(21) Appl. No.: 10/080,627

(22) Filed: Feb. 22, 2002

(51) Int. Cl.[7] ..... F21S 4/00

(52) U.S. Cl. ..... 362/145; 362/248; 362/249; 362/374

(58) Field of Search ..... 362/240, 248, 362/249, 374, 375, 152, 145, 151, 147

(56) References Cited

U.S. PATENT DOCUMENTS

D261,436 S 10/1981 Palsa et al.
5,404,279 A 4/1995 Wood
5,510,966 A 4/1996 Konecny
5,513,081 A 4/1996 Byers
5,594,628 A 1/1997 Reuter et al.
5,813,751 A 9/1998 Shaffer
6,088,967 A * 7/2000 Johnson ..... 52/28
6,224,232 B1 * 5/2001 Rodriguez ..... 440/38
6,309,086 B1 * 10/2001 Tomlinson ..... 362/249

* cited by examiner

*Primary Examiner*—Sandra O'Shea
*Assistant Examiner*—John Anthony Ward

(57) ABSTRACT

A storage and display apparatus for decorative lighting. The storage and display apparatus includes an elongate housing that has a main channel for holding strings of decorative lighting for the purpose of both displaying during the holiday season, and storage when not in use such as during the summer. The housing has an opening into the main channel for housing the lighting. A plurality of securing members selectively holds the decorative lighting in place in the main channel of the housing. Each of the securing members is mounted a back wall of the housing, and is generally a C-shaped design. A flexible panel member for selectively covering the opening of the housing can be slid up into a slot in an upper portion of the housing when not being utilized to cover the opening. The housing is mountable to a surface of a structure, such as under the eaves or gutters of a house.

14 Claims, 3 Drawing Sheets

STORAGE AND DISPLAY APPARATUS

BACKGROUND OF THE INVENTION

1. Field of the Invention

The present invention relates to lighting enclosures and more particularly pertains to a new storage and display apparatus for decorative lighting.

2. Description of the Prior Art

The use of lighting enclosures is known in the prior art. U.S. Pat. No. 5,813,751 describes a device for permanent installation of Christmas lighting. Another type of lighting enclosure is U.S. Pat. No. 5,594,628 which is a decorative exterior lighting system for use on a building.

While these devices fulfill their respective, particular objectives and requirements, the need remains for a device that is more universally mountable to different structures, and has a means to cover the opening to the lighting when not in use which is incorporated into the design, and is more aesthetically pleasing.

SUMMARY OF THE INVENTION

The present invention meets the needs presented above by incorporating a variety of ways to mount to a structure and includes a slidable, roll-top style front panel member which serves to cover the opening into the enclosure in an aesthetic manner and is stored out of view in an upper portion of the housing when not in use.

Still yet another object of the present invention is to provide a new storage and display apparatus that is universal in the sense that it is adaptable to a wide variety of structures.

To this end, the present invention generally comprises an elongate housing that has a main channel for holding strings of decorative lighting for the purpose of both displaying during the holiday season, and storage when not in use such as during the summer. The housing has an opening into the main channel for housing the lighting. A plurality of securing members selectively holds the decorative lighting in place in the main channel of the housing. Each of the securing members is mounted a back wall of the housing, and is generally a C-shaped design. A flexible panel member for selectively covering the opening of the housing can be slid up into a slot in an upper portion of the housing when not being utilized to cover the opening. The housing is mountable to a surface of a structure, such as under the eaves or gutters of a house.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
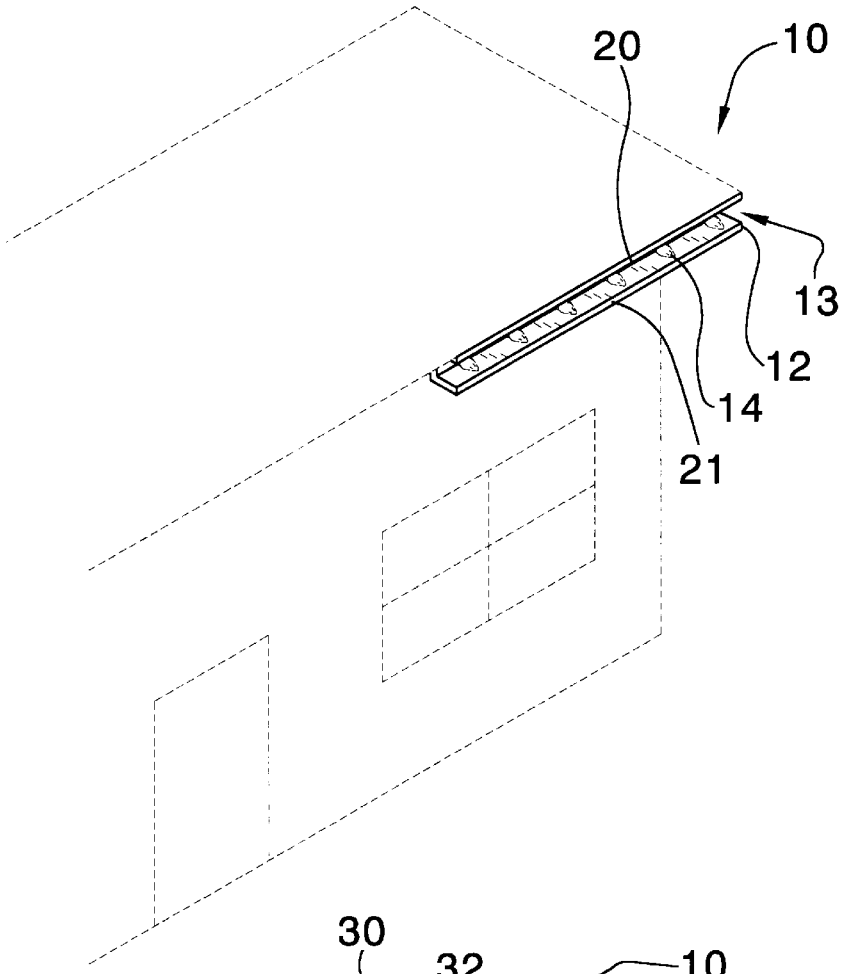
FIG. 1 is a schematic perspective view of a new storage and display apparatus according to the present invention amounted on a structure.
Figure 2:
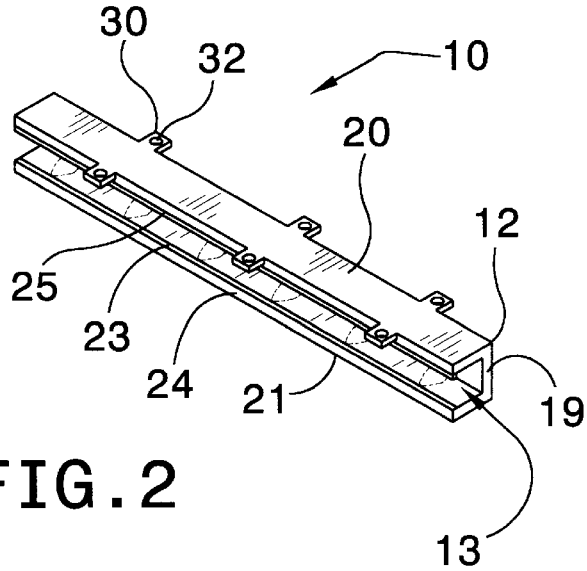
FIG. 2 is a schematic perspective view of the present invention.
Figure 4:
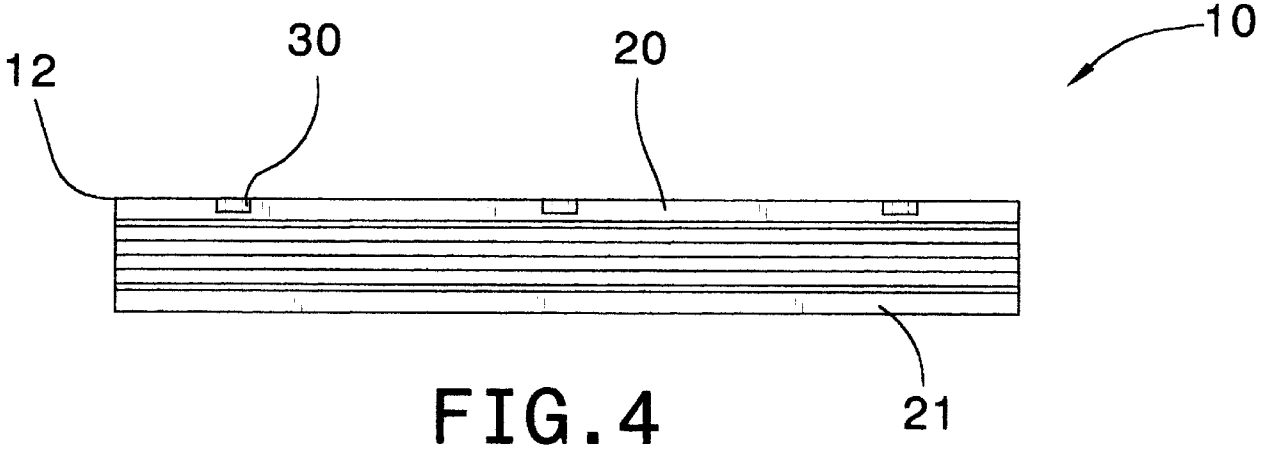
FIG. 4 is a schematic top view of the present invention.
Figure 3:
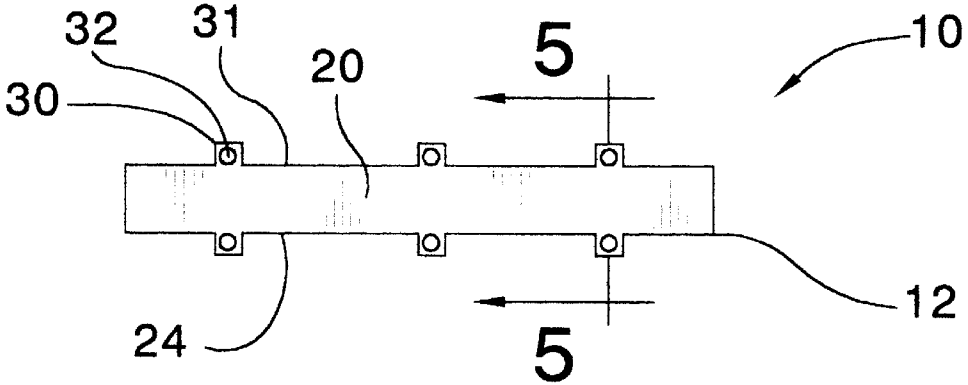
FIG. 3 is a schematic front view of the present invention with the panel member in the closed position.
Figure 6:
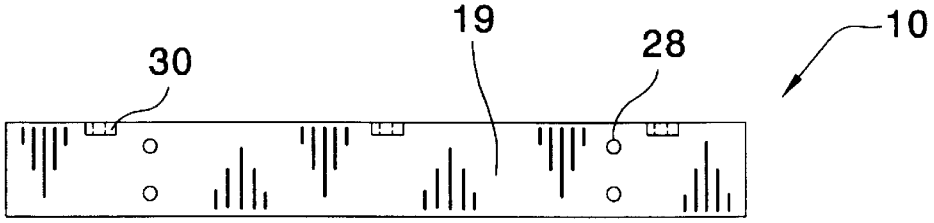
FIG. 6 is a schematic rear view of the present invention.
Figure 5:
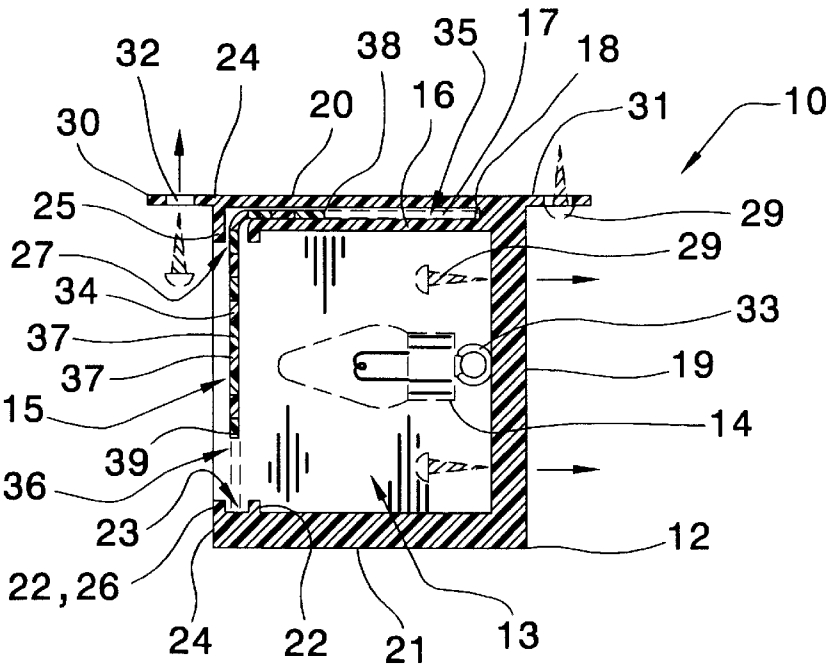
FIG. 5 is a schematic cross-sectional end view of the present invention.

With reference now to the drawings, and in particular to FIGS. 1 through 6 thereof, a new storage and display apparatus embodying the principles and concepts of the present invention and generally designated by the reference numeral 10 will be described.

As best illustrated in FIGS. 1 through 6, the storage and display apparatus 10 generally comprises an elongate housing 12 10 that has a main channel 13 for holding decorative lighting 14. The housing 12 has an opening 15 into the main channel 13. A partition wall 16 forms a slot 17 in an upper portion 18 of the housing 12. The housing 12 has a back wall 19, a top wall 20, and a bottom wall 21 defining the main channel 13. The partition wall 16 is positioned proximate to and is oriented substantially parallel to the top wall 20.

The bottom wall 21 has a pair of bottom ridges 22 that form a bottom channel 23 that is positioned adjacent to a front edge 24 of the bottom wall 21 and is oriented substantially parallel to the front edge 24 of the bottom wall 21.

The top wall 20 has an upper ridge 25 that extends toward the bottom wall 21. A front ridge 26 of the pair of bottom ridges 22 and the upper ridge 25 of the top wall 20 define the opening 15 into the housing 12. The partition wall 16 extends outward towards the upper ridge 25 such that a passage 27 to the slot 17 is formed.

The back wall 19 includes a plurality of holes 28 for receiving fasteners 29 to mount the housing 12 on a vertical support surface of a structure. Each of the holes 28 is spaced apart along a length of the housing 12.

The top wall 20 has a plurality of tabs 30 that extend away from the front edge 24 and a back edge 31 of the top wall 20 and are spaced apart along the length of the housing 12. Each of the tabs 30 has an aperture 32 for receiving fasteners 29 such that the housing 12 is mountable to an upper horizontal support surface of the structure.

A plurality of securing members 33 selectively holds the decorative lighting 14 in place in the main channel 13. Each of the securing members 33 is mounted on the back wall 19 and is positioned along the length of the housing 12 such that a string of the decorative lighting 14 is selectively positionable in the housing 12. Each of the securing members 33 is generally C-shaped.

A panel member 34 for selectively covering the opening 15 of the housing 12 is slidable into and out of the slot 17 in the housing 12. The panel member 34 is movable between an open position 35 and a closed position 36.

A relatively larger portion of the panel member 34 being positioned in the slot 17 than out of the slot 17 such that the opening 15 of the housing 12 is substantially uncovered characterizes the open position 35. A relatively larger portion of the panel member 34 being positioned out of the slot 17 such that the opening 15 of the housing 12 is substantially covered characterizes the closed position 36.

The panel member 34 comprises a plurality of parallel slats 37 each having a length generally equal to the length of the housing 12. Each of the slats 37 is flexibly coupled together such that the panel member 34 is slidably movable into and out of the slot 17.

The panel member 34 has a top edge 38 and a bottom edge 39. The bottom edge 39 of the panel member 34 is positioned in the bottom channel 23, and the top edge 38 is positioned in the passage 27 to the slot 17 when in the closed position 36.

The panel member 34 has a thickness generally equal to the slot 17 in the housing 12, and a height generally equal to a distance between the top wall 20 and the bottom wall 21.

In the respective drawings only a short section of the housing is depicted, wherein in actual use the housing can be produced in a wide variety of sizes and lengths to accommodate the necessary dimensional requirements. Basic end caps and corner pieces can easily be made to conform to the housing and the different structure requirements and henceforth should be considered as included in conjunction with the invention.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A storage and display apparatus for decorative lighting, said apparatus comprising:

an elongate housing having a main channel for holding the decorative lighting, said housing having an opening into said main channel;

a plurality of securing members for selectively holding the decorative lighting in place in said main channel of said housing;

a panel member for selectively covering said opening of said housing; and said housing including a partition wall forming a slot in an upper portion of said housing, said housing having a back wall, a top wall, and a bottom wall defining said main channel, said partition wall being positioned proximate to and being oriented substantially parallel to said top wall.

2. The storage and display apparatus as set forth in claim 1, further comprising said bottom wall having a pair of bottom ridges forming a bottom channel, said bottom channel being positioned adjacent to a front edge of said bottom wall, said bottom channel being oriented substantially parallel to said front edge of said bottom wall.

3. The storage and display apparatus as set forth in claim 2, further comprising said top wall having an upper ridge extending toward said bottom wall, a front ridge of said pair of bottom ridges and said upper ridge of said top wall defining said opening into said housing.

4. The storage and display apparatus as set forth in claim 3, further comprising said top wall having a plurality of tabs extending away from said front edge and a back edge of said top wall and being spaced apart along a length of said housing.

5. The storage and display apparatus as set forth in claim 4, further comprising each of said tabs having an aperture extending therethrough for receiving fasteners such that said housing is mountable to an upper horizontal support surface of the structure.

6. The storage and display apparatus as set forth in claim 1, further comprising said partition wall extending outwardly towards an upper ridge of said top wall such that a passage to said slot is formed.

7. The storage and display apparatus as set forth in claim 1, further comprising said back wall including a plurality of holes extending therethrough for receiving fasteners to mount said a housing on a vertical support surface of a structure, each of said holes being spaced apart along a length of said housing.

8. The storage and display apparatus as set forth in claim 1, further comprising each of said securing members being mounted on said back wall and being positioned along a length of said housing such that a string of the decorative lighting is selectively positionable in said housing, each of said securing members being generally C-shaped.

9. The storage and display apparatus as set forth in claim 1, further comprising said panel member being slidable into and out of said slot in said housing, said panel member being movable between an open position and a closed position.

10. The storage and display apparatus as set forth in claim 9, wherein said open position is characterized by a relatively larger portion of said panel member being positioned in said slot than out of said slot such that said opening of said housing is substantially uncovered, and said closed position is characterized by a relatively larger portion of said panel member being positioned out of said slot such that said opening of said housing is substantially covered.

11. The storage and display apparatus as set forth in claim 9, further comprising said panel member comprising a plurality of parallel slats each having a length generally equal to a length of said housing, each of said slats being flexibly coupled together such that said panel member is slidably movable into and out of said slot.

12. The storage and display apparatus as set forth in claim 9, further comprising said panel member having a top edge and a bottom edge, wherein said bottom edge of said panel member is positioned in a bottom channel of said bottom wall and said top edge is positioned in a passage to said slot when in a closed position.

13. The storage and display apparatus as set forth in claim 1, further comprising said panel member having a thickness generally equal to said slot in said housing, said panel member having a height generally equal to a distance between said top wall and said bottom wall.

14. A storage and display apparatus for decorative lighting, said apparatus comprising:

an elongate housing having a main channel for holding the decorative lighting, said housing having an opening into said main channel, said housing including a partition wall forming a slot in an upper portion of said housing, said housing having a back wall, a top wall, and a bottom wall defining said main channel, said partition wall being positioned proximate to and being oriented substantially parallel to said top wall, said bottom wall having a pair of bottom ridges forming a bottom channel, said bottom channel being positioned adjacent to a front edge of said bottom wall, said bottom channel being oriented substantially parallel to said front edge of said bottom wall, said top wall having an upper ridge extending toward said bottom wall, a front ridge of said pair of bottom ridges and said upper ridge of said top wall defining said opening into said housing, said partition wall extending outwardly towards said upper ridge of said top wall such that a passage to said slot is formed, said back wall including a plurality of holes extending therethrough for receiving fasteners to mount said housing on a vertical support surface of a structure, each of said holes being spaced apart along a length of said housing, said top wall having a plurality of tabs extending away from said front edge and a back edge of said top wall and being spaced apart along the length of said housing, each of said tabs having an aperture extending therethrough for receiving fasteners such that said housing is mountable to an upper horizontal support surface of the structure;

a plurality of securing members for selectively holding the decorative lighting in place in said main channel of said housing, each of said securing members being mounted on said back wall and being positioned along the length of said housing such that a string of the decorative lighting is selectively positionable in said housing, each of said securing members being generally C-shaped; and a panel member for selectively covering said opening of said housing, said panel member being slidable into and out of said slot in said housing, said panel member being movable between an open position and a closed position, wherein said open position is characterized by a relatively larger portion of said panel member being positioned in said slot than out of said slot such that said opening of said housing is substantially uncovered, and said closed position is characterized by a relatively larger portion of said panel member being positioned out of said slot such that said opening of said housing is substantially covered, said panel member comprising a plurality of parallel slats each having a length generally equal to the length of said housing, each of said slats being flexibly coupled together such that said panel member is slidably movable into and out of said slot, said panel member having a top edge and a bottom edge, wherein said bottom edge of said panel member is positioned in said bottom channel and said top edge is positioned in said passage to said slot when in said closed position, said panel member having a thickness generally equal to said slot in said housing, said panel member having a height generally equal to a distance between said top wall and said bottom wall.

* * * * *